US010084260B2

(12) United States Patent
Fabre et al.

(10) Patent No.: US 10,084,260 B2
(45) Date of Patent: Sep. 25, 2018

(54) CONNECTOR SYSTEM AND METHOD OF ASSEMBLING SAME

(71) Applicant: Delphi International Operations Luxembourg S.A.R.L., Bascharage (LU)

(72) Inventors: Jean Fabre, Chartres (FR); Stephane Lacote, Prunay-en-Yvelines (FR)

(73) Assignee: DELPHI INTERNATIONAL OPERATIONS LUXEMBOURG S.A.R.L., Luxembourg (LU)

( * ) Notice: Subject to any disclaimer, the term of this patent is extended or adjusted under 35 U.S.C. 154(b) by 0 days.

(21) Appl. No.: 15/584,713

(22) Filed: May 2, 2017

(65) Prior Publication Data

US 2017/0324191 A1 Nov. 9, 2017

(51) Int. Cl.
*H01R 3/00* (2006.01)
*H01R 13/62* (2006.01)
*H01R 9/24* (2006.01)

(52) U.S. Cl.
CPC ..... *H01R 13/62* (2013.01); *H01R 9/24* (2013.01)

(58) Field of Classification Search
CPC ..... H01R 13/6397; H01R 13/6272; H01R 13/6275; H01R 13/465; H01R 13/641; H01R 12/7052; H01R 23/7042
USPC ..... 439/304, 352, 353, 357, 488, 489, 572, 439/573
See application file for complete search history.

(56) References Cited

U.S. PATENT DOCUMENTS 5,910,027 A * 6/1999 Wayt ..... H01R 13/641 439/352
5,928,038 A * 7/1999 Berg ..... H01R 13/6272 439/489
6,068,507 A * 5/2000 Popa ..... H01R 13/641 439/352
6,435,895 B1 * 8/2002 Fink ..... H01R 13/6272 439/352

(Continued)

FOREIGN PATENT DOCUMENTS

DE 102011006479 A1 10/2012
EP 2871724 A1 5/2015

(Continued)

*Primary Examiner* — Thanh Tam Le
(74) *Attorney, Agent, or Firm* — Robert J. Myers

(57) ABSTRACT

A connector system is described herein. The connector system includes a first connector having a first fastener and a second connector having a second fastener cooperating with the first fastener to fasten the first connector to the second connector. The first connector includes a blocking component that is moveable between a blocking position, in which the blocking component is locked and prevents cooperation of the first fastener with the second fastener, and an non-blocking position in which the blocking component allows the first fastener to cooperate with the second fastener. The second connector includes a marker interacting with the blocking component in order to unlock the blocking component when the first and second connectors are in a position for connection, thereby allowing movement of the blocking component from the blocking position to the non-blocking position. A method of assembling such a connector system is also presented.

13 Claims, 3 Drawing Sheets

(56) References Cited

U.S. PATENT DOCUMENTS

| | | | | |
|---|---|---|---|---|
| 6,527,578 | B2 * | 3/2003 | Kashiyama | H01R 13/641 439/352 |
| 6,592,404 | B2 * | 7/2003 | Endo | H01R 13/641 439/357 |
| 6,796,838 | B2 * | 9/2004 | Yoshioka | H01R 13/648 439/607.01 |
| 7,048,586 | B2 * | 5/2006 | Ishizaki | H01R 9/05 439/108 |
| 7,326,074 | B1 * | 2/2008 | Lim | H01R 13/629 439/352 |
| 7,614,904 | B2 * | 11/2009 | Hiramatsu | H01R 13/641 439/352 |
| 7,614,910 | B2 * | 11/2009 | Croteau | H01R 13/512 439/559 |
| 8,010,606 | B2 * | 8/2011 | Van Datta | A63F 13/12 709/205 |
| 8,376,768 | B2 * | 2/2013 | Kurumizawa | B60L 11/14 439/304 |
| 8,449,323 | B2 * | 5/2013 | Omae | H01R 13/5202 439/559 |
| 8,678,846 | B2 * | 3/2014 | Hitchcock | H01R 13/6272 439/352 |
| 8,926,355 | B2 * | 1/2015 | Heil | H01R 13/641 439/352 |
| 9,312,626 | B2 * | 4/2016 | Itsuki | H01R 13/5208 |

FOREIGN PATENT DOCUMENTS

| | | | |
|---|---|---|---|
| FR | 3005794 | A1 | 11/2014 |
| WO | 2014195747 | A1 | 12/2014 |

* cited by examiner

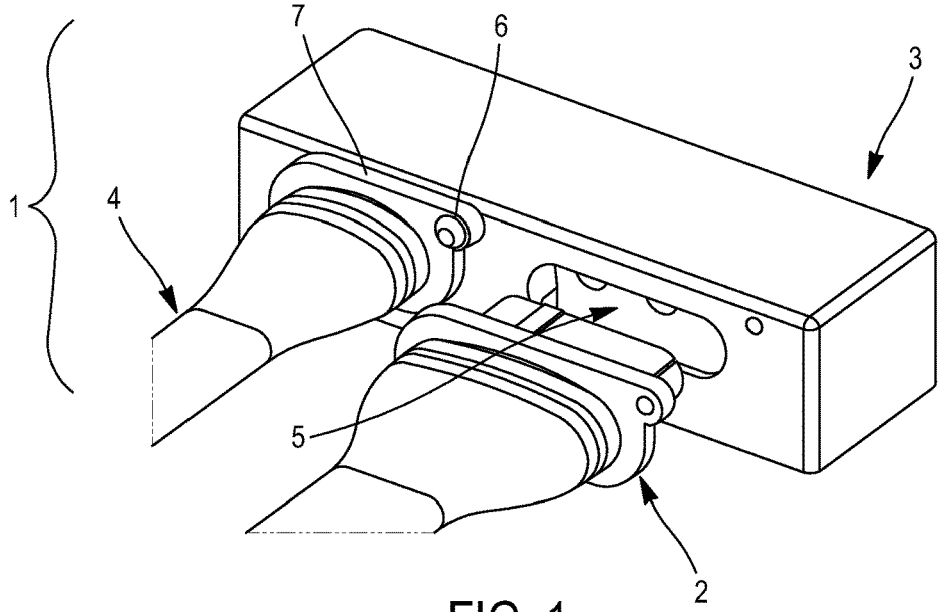
FIG. 1
PRIOR ART
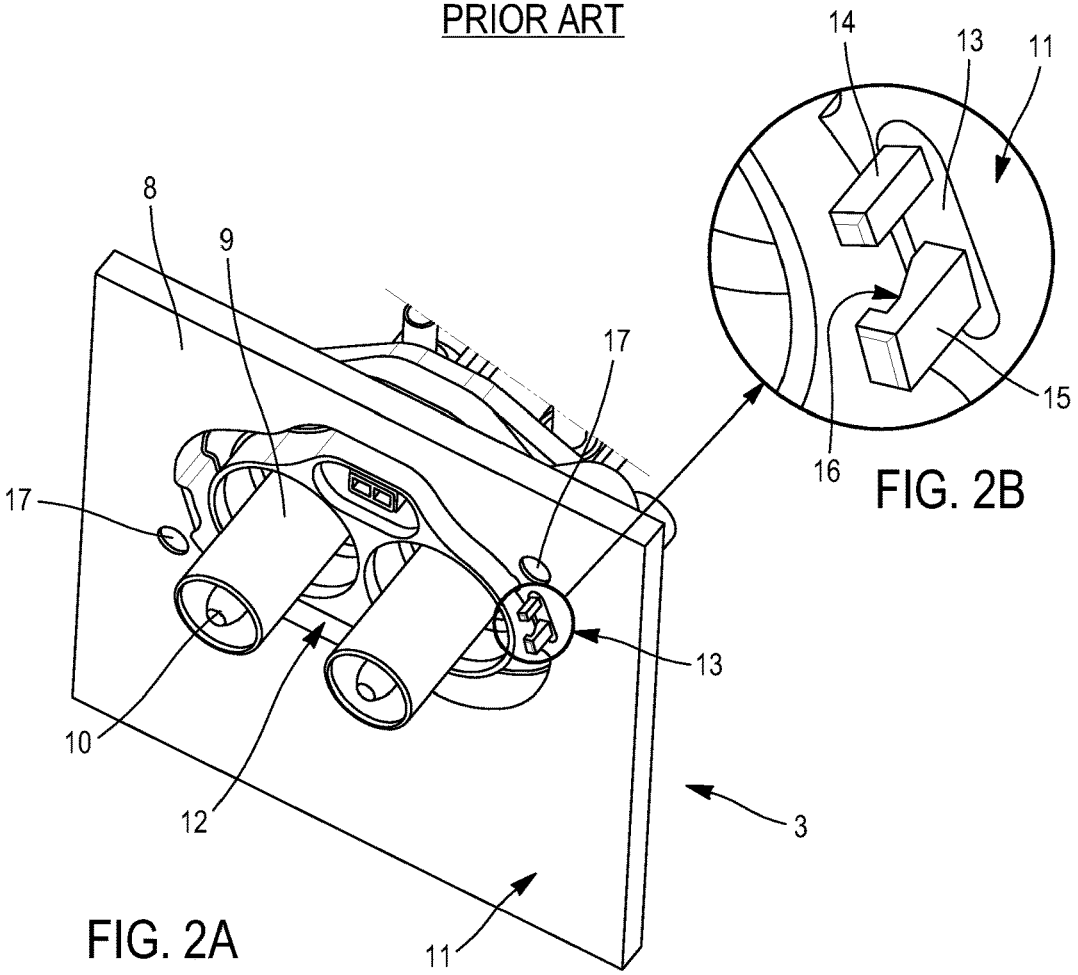
FIG. 2B
FIG. 2A

CONNECTOR SYSTEM AND METHOD OF ASSEMBLING SAME

CROSS-REFERENCE TO RELATED APPLICATION

This application claims the benefit under 35 U.S.C. § 119(a) of Patent Application No. 1654110 filed in the Institut National de la Proprété Industrielle (French Patent Office) on May 9, 2016, the entire disclosure of which is hereby incorporated by reference.

TECHNICAL FIELD OF THE INVENTION

The invention relates to the domain of connectors and in particular, but not exclusively, the domain of electrical connectors for automotive vehicles.

BACKGROUND OF THE INVENTION

FIG. 1 shows an example of a connector system of the prior art for high voltage current. According to this example, the connector system 1 comprises a first 2 and a second 3 connector. The first connector 2 comprises for example pins (male contacts) connected to electric cables 4. The second connector 3 includes for example female contacts, into which the pins of the first connector 2 must be inserted. These female contacts are for example electrically connected to electrical conducting bars (bus bars) and/or to devices 5 (current converters, motors, etc.) accommodated in the second connector 3. The first connector 2 is mounted on the second connector 3, then the first 2 and second 3 connectors are fastened to each other by means of screws 6 inserted in a flange 7 on the first connector 2 side before being screwed to the second connector 3.

It happens that, because of insufficiently precise positioning between the first and second connectors before fastening them, the operators responsible for assembling them encounter problems. For example, the first and second connectors are screwed when they are not correctly oriented relative to each other; screwing is difficult, in particular in the motor compartment of a vehicle, where there is not necessarily much room: screwing is skewed or is incomplete; etc. Therefore, improvement of the assembly ergonomics of the connector systems remains possible.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

According to one embodiment, a connector system is provided. The connector system includes a first connector having a first fastener and a second connector having a second fastener cooperating with the first fastener to fasten the first connector to the second connector. The first connector includes a blocking component that is moveable between a blocking position, in which the blocking component is locked and prevents cooperation of the first fastener with the second fastener, and an non-blocking position in which the blocking component allows the first fastener to cooperate with the second fastener. The second connector includes a marker interacting with the blocking component in order to unlock the blocking component when the first and second connectors are in a position for connection, thereby allowing movement of the blocking component from the blocking position to the non-blocking position.

The first fastener may comprise a shaft and the second fastener may define a cavity configured to receive the shaft. The blocking component is interposed between the shaft and the cavity in the blocking position.

The first connector may include a flange with a aperture defined therethrough. The aperture is configured to allow passage of the shaft through the flange. The blocking component at least partially obstructs the aperture in the blocking position and is clear of the aperture in the non-blocking position. The blocking component may interact with the second connector when the blocking component is in the non-blocking position in order to secure the first connector to the second connector.

The marker may comprise a first finger extending substantially perpendicular to a coupling face of the second connector and may be characterized as a straight prism with a square base. The marker may further comprise a second finger extending substantially parallel to the first finger. A free end of the second finger is characterized as having a hooked shape.

The flange may include a divider configured to guide the blocking component from the blocking position to the non-blocking position. The divider may be provided with a ramp configured to raise the blocking component relative to the flange as the blocking component moves from the blocking position to the non-blocking position.

The blocking component may includes a push button configured to partially obstructs the aperture in the blocking position. The blocking component may include a tab having a first flexible fin and a second flexible fin that diverge from a free end of the tab. The blocking component may be held on the flange by the push button resting on the divider and an end of the first flexible fin inserted under a first projection defined by the flange.

The second flexible fin may be inserted under a second projection defined by the flange. The second flexible fin is trapped by a notch forming a stop configured to inhibit. Interaction of the stop and the second flexible fin inhibits the blocking component from moving from the blocking position to the non-blocking position until the first finger of the marker penetrates the stop, thereby moving the second flexible fin from a protruding position, in which it locks the blocking component in the blocking position, to a retracted position in which it frees the movement of the blocking component.

The second flexible fin may be under the hooked free end of the second finger of the marker as the blocking component is moved from the blocking position to the non-blocking position, thereby securing the flange on the coupling face.

According to another embodiment, a method of assembling a connector system is provided. The method includes the steps of providing a first connector having a first fastener and a second connector having a second fastener, wherein the second fastener cooperates with the first fastener to secure the first connector to the second connector, unlocking a blocking component present on the first connector with a marker present on the second connector by placing the first and second connectors in a position for connection, and moving the blocking component from a blocking position in which the blocking component prevents the first fastener from cooperating with the second fastener to an non-blocking position which allows the first fastener to cooperate with the second fastener.

The first connector may include a flange defining a aperture therethrough that is configured to allow passage of a shaft the first fastener through the flange. The blocking component at least partially obstructs the aperture in the blocking position and does not obstruct the aperture in the non-blocking position. The method may further compromise the step of inserting the shaft through the aperture when the blocking is in the non-blocking position.

BRIEF DESCRIPTION OF THE SEVERAL VIEWS OF THE DRAWING

The present invention will now be described, by way of example with reference to the accompanying drawings, in which:

FIG. 1 diagrammatically shows, in perspective, an example of a connector system of the prior art;

FIG. 2A diagrammatically shows, in perspective, a connector according to an embodiment example of a connector system according to the invention; FIG. 2B shows a magnification of an area of FIG. 2A, showing the detail of a marker;

In this document, the terms frontal, forward, rear, top, bottom, upper, lower, etc. are purely conventional and refer, where applicable, to the orientations as shown on the figures.

In the figures, the same reference numbers designate identical or similar items.

DETAILED DESCRIPTION OF THE INVENTION

A non-limiting example of a connector system 1 is depicted in FIGS. 2 to 12.

According to this example, the connector system 1 is intended to be integrated into a high voltage circuit.

Figure 9:
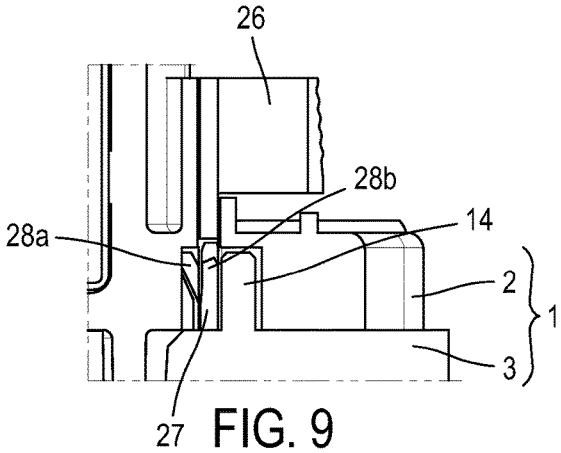
FIG. 9 corresponds to a diagrammatic sectional view of the connector portion shown in FIGS. 3 to 8, coupled with the connector of FIGS. 2A and 2B.
Figure 10:
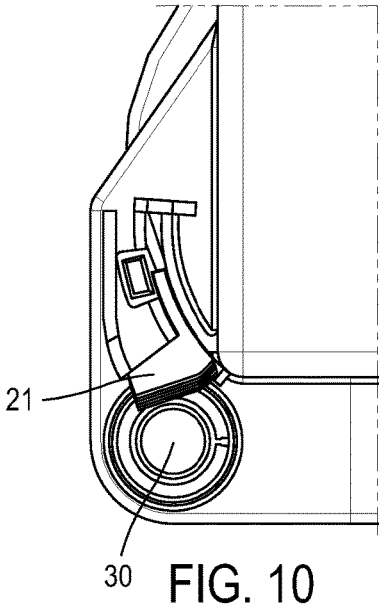
FIG. 10 corresponds to a diagrammatic top view of the connector system portion shown in FIG. 9.

The connector system 1 comprises a first 2 and a second 3 connector (see FIG. 9). These first 2 and second 3 connectors are therefore relatively voluminous and heavy, and above all, the cables to which at least one of them can be connected may be relatively rigid. The contrivances required for their installation and maintenance must be robust and allow easy handling by an operator.

As shown in FIG. 2A, the second connector 3 includes a mounting 8, a plate or wall, fed through by two sleeves 9, in which the pins 10 are accommodated, each pin connected respectively to a cable and/or to a bus bar (not illustrated). The sleeves 9 extend longitudinally, each respectively parallel to an axis, itself perpendicular to the mounting 8. The sleeves protrude on a coupling face 11, while the pins 10 are connected to the cables and/or to a bus bar by an end situated on the side of the face lying opposite the coupling face 11. The sleeves 9 are surrounded by a recess 12, designed to accommodate a seal (not illustrated). On the outside of this recess 12, relative to the sleeves 9, and at the periphery of the recess, an indicator or marker 13 is present. The marker 13 may be made on a single piece with the mounting 8. Alternatively, the mounting 8 and the marker 13 can consist of units formed in different materials (for example, the marker 13 is in a plastic material while the mounting 8 corresponds to a box wall in metal).

As shown in more detail in FIG. 2B, the marker 13 includes two fingers 14, 15 extending substantially perpendicular to the coupling face 11. The first finger 14 of these two fingers 14, 15 has a shape substantially of a straight prism with a square base. The second finger 15 of these two fingers 14, 15, extending substantially parallel to the first finger 14, is more voluminous and includes a free end in the shape of a hook 16.

The second connector 3 includes fastener 17, each here in the shape of a cavity, formed for example by a threaded bore, extending longitudinally perpendicular to the coupling face.

The first connector 2 accommodates, although they are not visible on the figures, female contacts, or sockets, connected to cables and designed to be connected to the pins 10 of the second connector 3. The first connector 2 is made for example in a molded plastic material.

A flange 18 designed to be applied to the coupling face 11 of the second connector 3 extends on the periphery of the first connector 2. The flange 18 is pierced by one or several apertures 19 passing through the flange in a direction perpendicular to it. These apertures 19 are potentially lined with a metal reinforcing ring 20 (see FIG. 3).

Figure 3:
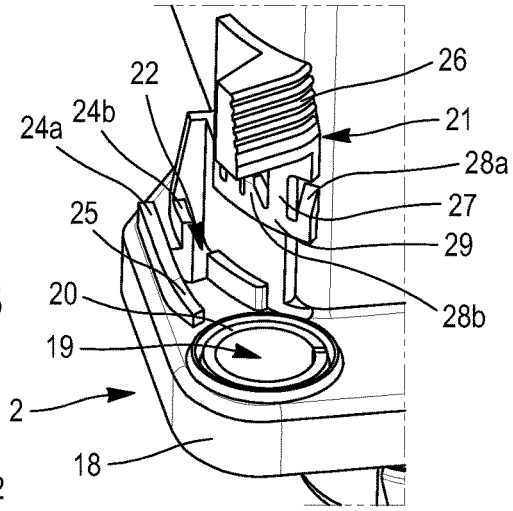
FIG. 3 diagrammatically shows, in perspective, a portion of flange and a blocking component of another connector from the connector system comprising the connector of FIG. 2A.

At least one blocking component 21 is installed near a aperture 19. In FIG. 3, the blocking component 21 is shown above a housing 22, in which it must be fitted in a moveable manner. This housing 22 includes a slot, curved here in part, through the flange 18 so that, in its movement, the blocking component 21 bears on a wall of the first connector 2, and is partially guided by this wall. The shape of the housing 22 chosen here makes it possible to limit the size of this housing 22 and of the flange 18.

Dividers 24*a*, 24*b* protect and guide the blocking component 21 in its movement from its blocking position to its non-blocking position and vice-versa. One 24*a* of these dividers 24*a*, 24*b* is provided with a ramp 25 making it possible to raise the blocking component 21 relative to the flange 18 as it passes from its blocking position to its non-blocking position (the function of this characteristic is described later).

The blocking component 21 is molded for example in a plastic material. It includes a push button 26 to facilitate its manipulation by an operator. It also includes a tab 27 extending longitudinally, perpendicular to the direction in which the blocking component 21 is designed to be moved from its blocking position to its non-blocking position. The tab 27 is provided with a first 28*a* and a second 28*b* flexible fin. These first 28*a* and second 28*b* fins diverge from the tab 27 away from the free end 29 of the latter.

Figure 4:
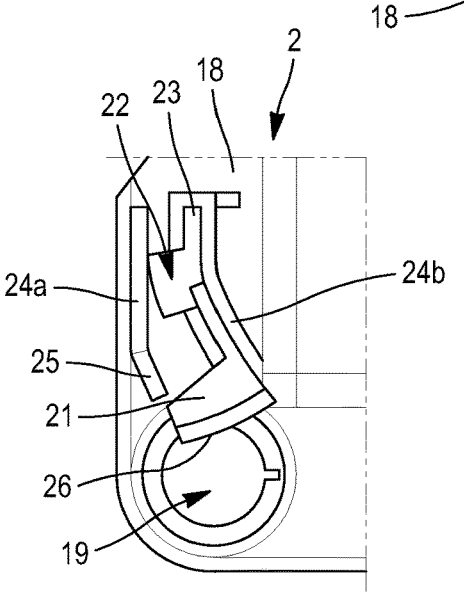
FIG. 4 corresponds to a diagrammatic top view of the connector portion shown in FIG. 3.
Figure 5:
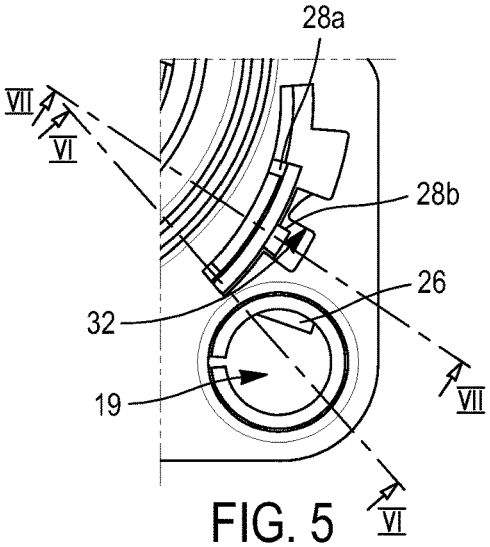
FIG. 5 corresponds to a diagrammatic bottom view of the connector portion shown in FIGS. 3 and 4.

In FIGS. 4 and 5, the blocking component 21 is shown, viewed respectively from above and below, in the blocking position. In this position, a portion of the blocking component 21, here of the push button 26, partially obstructs the aperture 19. The blocking component 21 therefore opposes the installation of fastener enabling the first 2 and the second 3 connectors to be held together, and which would consist of a screw 30 to be screwed into the threaded cavity 17.

Figure 6:
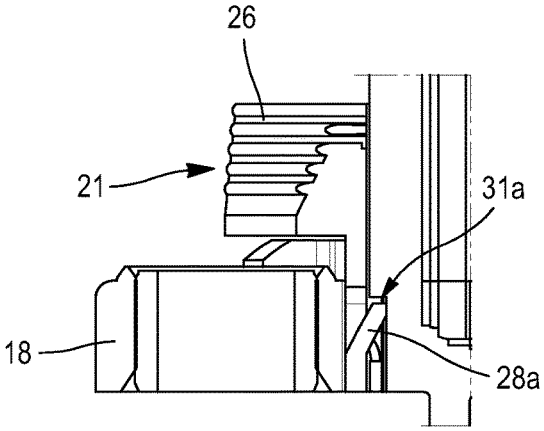
FIG. 6 shows a detail of the section VI-VI of FIG. 5.
Figure 7:
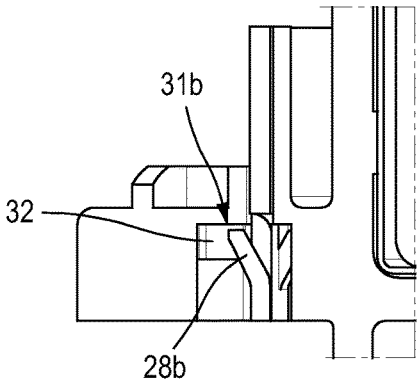
FIG. 7 shows a detail of the section VII-VII of FIG. 5.
Figure 8:
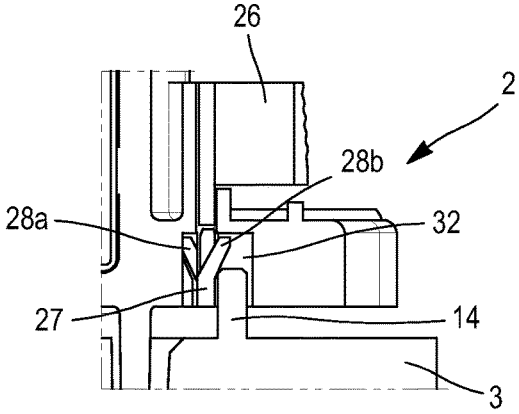
FIG. 8 corresponds to a diagrammatic sectional view of the connector portion shown in FIGS. 3 to 7, in a partially coupled position with the connector of FIGS. 2A and 2B.

As can be seen in FIG. 6, the blocking component 21 is held on the flange 18 by the fact that it makes a sandwich of a portion of the flange 18, between, on the one hand, the push button 26 resting on a divider 24*b*, and on the other, an end of the first fin 28*a* inserted under a projection 31*a*. Along the sectional plane of FIG. 7, the second fin 28*b* can be seen also to be resting under an opposite projection 31*b*. This second fin 28*b* is furthermore trapped by a notch forming a stop 32 (also see FIG. 5). The interaction of this stop 32 and of the second fin 28*b* prevents the blocking component 21 from moving from its blocking position to its non-blocking position.

When the first 2 and the second 3 connectors are coupled, the first finger 14 of the marker 13 penetrates the stop 32 (see FIG. 8), it interacts with the second fin 28*b*, and causes it to pass from a protruding position, in which it locks the blocking component 21 in the blocking position, to a retracted position in which it frees the movement of the blocking component. In the retracted position, the second fin 28*b* is substantially parallel to the tab 27 and has escaped from the stop 32 (see FIG. 9).

Figure 11:
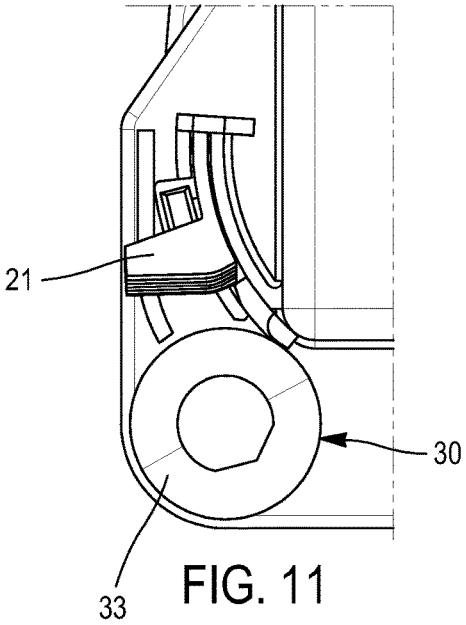
FIG. 11 corresponds to a diagrammatic top view of the connector system portion shown in FIGS. 9 and 10.
Figure 12:
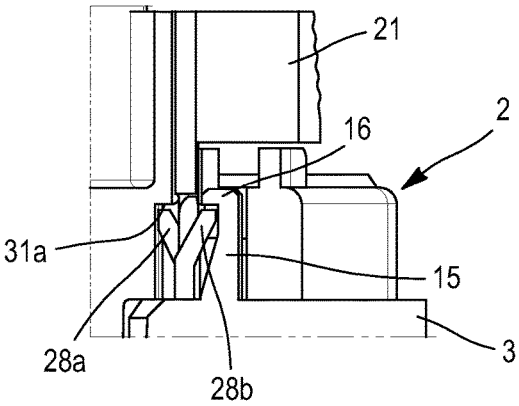
FIG. 12 corresponds to an illustration similar to that of FIG. 9, but with a different sectional plane.

The blocking component 21 is then unlocked and an operator pressing the push button 26, substantially parallel to the plane of the flange 18, can move the blocking component 21 from its blocking position (FIG. 10) to its non-blocking position (FIG. 11). In the non-blocking position, the blocking component 21 has freed the aperture 19 and a shaft (here, the screw 30 with a threaded shaft provided with a head 33) can be inserted there in order to fasten and tighten the flange 18 on the coupling face 11.

When the blocking component 21 moves, the second fin 28*b* places itself under the hook 16 of the second finger 15 of the marker 13. The fact of causing the push button 26 to rise up the ramp 25 furthermore allows the first 28*a* and the second 28*b* fins to rise and to exert an additional force respectively on the projection 31*a* and on the hook 16 so as to tighten the flange 18 on the coupling face 11. The resulting tightening force makes it possible to hold the blocking component 21 in the non-blocking position, as well as holding the first 2 and second 3 connectors in place one on the other for the time of putting in place and tightening the shaft in the threaded cavity 17.

While this invention has been described in terms of the preferred embodiments thereof, it is not intended to be so limited, but rather only to the extent set forth in the claims that follow. Moreover, the use of the terms first, second, primary secondary, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

We claim:

1. A connector system, comprising:

a first connector having a first fastener; and a second connector having a second fastener cooperating with the first fastener to fasten the first connector to the second connector, wherein the first connector includes a blocking component that is moveable between a blocking position, in which the blocking component is locked and prevents cooperation of the first fastener with the second fastener, and a non-blocking position in which the blocking component allows the first fastener to cooperate with the second fastener, wherein the second connector includes a marker comprising a first finger extending substantially perpendicular to a coupling face of the second connector and characterized as a straight prism with a square base, said marker interacting with the blocking component in order to unlock the blocking component when the first and second connectors are in a position for connection, thereby allowing movement of the blocking component from the blocking position to the non-blocking position; and wherein the marker comprises a second finger extending substantially parallel to the first finger and wherein a free end of the second finger is characterized as having a hooked shape.

2. The connector system according to claim 1, wherein the first fastener comprises a shaft and the second fastener defines a cavity configured to receive the shaft and wherein the blocking component is interposed between the shaft and the cavity in the blocking position.

3. A connector system, comprising:

a first connector having a first fastener comprising a shaft and a flange with an aperture defined therethrough and configured to allow passage of the shaft through the flange; and a second connector having a second fastener having a cavity configured to receive the shaft, thereby cooperating with the first fastener to fasten the first connector to the second connector, wherein the first connector includes a blocking component that is moveable between a blocking position in which the blocking component is interposed between the shaft and the cavity, thereby locking the blocking component and preventing cooperation of the first fastener with the second fastener, and an non-blocking position in which the blocking component allows the first fastener to cooperate with the second fastener, wherein the blocking component at least partially obstructs the aperture in the blocking position and is clear of the aperture in the non-blocking position, and wherein the second connector includes a marker interacting with the blocking component in order to unlock the blocking component when the first and second connectors are in a position for connection, thereby allowing movement of the blocking component from the blocking position to the non-blocking position.

4. The connector system according to claim 3, wherein the blocking component interacts with the second connector when the blocking component is in the non-blocking position in order to secure the first connector to the second connector.

5. The connector system according to claim 4, wherein the marker comprises a first finger extending substantially perpendicular to a coupling face of the second connector and characterized as a straight prism with a square base.

6. The connector system according to claim 5, wherein the marker further comprises a second finger extending substantially parallel to the first finger and wherein a free end of the second finger is characterized as having a hooked shape.

7. The connector system according to claim 6, wherein the flange includes a divider configured to guide the blocking component from the blocking position to the non-blocking position.

8. The connector system according to claim 7, wherein the divider is provided with a ramp configured to raise the blocking component relative to the flange as the blocking component moves from the blocking position to the non-blocking position.

9. The connector system according to claim 8, wherein the blocking component includes a push button configured to partially obstructs the aperture in the blocking position.

10. The connector system according to claim 9, wherein the blocking component includes a tab having a first flexible fin and a second flexible fin that diverge from a free end of the tab.

11. The connector system according to claim 10, wherein the blocking component is held on the flange by the push button resting on the divider and an end of the first flexible fin inserted under a first projection defined by the flange.

12. The connector system according to claim 11, wherein the second flexible fin is inserted under a second projection defined by the flange, wherein the second flexible fin is trapped by a notch forming a stop configured to inhibit, and wherein interaction of the stop and the second flexible fin inhibits the blocking component from moving from the blocking position to the non-blocking position until the first finger of the marker penetrates the stop thereby moving the second flexible fin from a protruding position, in which the second flexible fin locks the blocking component in the blocking position, to a retracted position in which the second flexible fin frees the movement of the blocking component.

13. The connector system according to claim 12, wherein the second flexible fin is under the hooked free end of the second finger of the marker as the blocking component is moved from the blocking position to the non-blocking position, thereby securing the flange on the coupling face.

* * * * *